US011076676B2

(12) United States Patent
Castex et al.

(10) Patent No.: US 11,076,676 B2
(45) Date of Patent: Aug. 3, 2021

(54) DEVICE FOR DISPENSING AND APPLYING A COSMETIC OR CARE PRODUCT

(71) Applicant: CHANEL PARFUMS BEAUTE, Neuilly-sur-Seine (FR)

(72) Inventors: Nicolas Castex, Colombes (FR); Floriane Peronne, Paris (FR); Antoine Cayron, Forest (BE)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 16/633,988

(22) PCT Filed: Jul. 18, 2018

(86) PCT No.: PCT/FR2018/051831
§ 371 (c)(1),
(2) Date: Jan. 24, 2020

(87) PCT Pub. No.: WO2019/020907
PCT Pub. Date: Jan. 31, 2019

(65) Prior Publication Data

US 2020/0214421 A1 Jul. 9, 2020

(30) Foreign Application Priority Data

Jul. 26, 2017 (FR) ..... 1757086

(51) Int. Cl.
*B43K 5/06* (2006.01)
*A45D 34/04* (2006.01)
(Continued)

(52) U.S. Cl.
CPC ..... *A45D 34/04* (2013.01); *A45D 40/265* (2013.01); *A45D 40/04* (2013.01);
(Continued)

(58) Field of Classification Search
CPC ..... A45D 34/04; A45D 40/26; A45D 40/265; A45D 2200/053; A45D 2200/055; B05C 17/005; B05C 17/00503
(Continued)

(56) References Cited

U.S. PATENT DOCUMENTS 64,732 A 5/1867 Wylie
6,746,170 B2 * 6/2004 Delage ..... A45D 40/26 401/171
(Continued)

FOREIGN PATENT DOCUMENTS

FR 2639260 5/1990
WO 2012/102427 8/2012

OTHER PUBLICATIONS

International Search Report issued in International Patent Application No. PCT/FR2018/051831, dated Oct. 23, 2018; and English-language translation thereof.

*Primary Examiner* — Jennifer C Chiang
(74) *Attorney, Agent, or Firm* — Greenblum & Bernstein, P.L.C.

(57) ABSTRACT

Device for dispensing and applying a liquid, semi-fluid, or pasty cosmetic or care product having an elongate and hollow rotary body and an elongate and hollow outer shaft butted together and rotatable one to the other, an applicator endpiece secured to the end of the rotary body, the rotary body and outer shaft forming an interior volume in which a pierced cylinder having a longitudinal duct is formed, and an inner shaft having an open end through which the pierced cylinder is introduced and a closed end forming a reservoir for the product. The pierced cylinder is fixed in translation with respect to the rotary body. A mechanism of the device converts rotation of the rotary body with respect to the outer shaft into movement of the inner shaft in translation with
(Continued)

respect to the pierced cylinder in the interior volume formed by the rotary body and the outer shaft.

13 Claims, 8 Drawing Sheets

(51) Int. Cl.
*A45D 40/26* (2006.01)
*A45D 40/04* (2006.01)
*A45D 40/00* (2006.01)

(52) U.S. Cl.
CPC ..... *A45D 2040/0006* (2013.01); *A45D 2200/053* (2013.01); *A45D 2200/055* (2013.01)

(58) Field of Classification Search
USPC ..... 401/172–174
See application file for complete search history.

(56) References Cited

U.S. PATENT DOCUMENTS 7,192,212 B2 * 3/2007 Gutberlet ..... A45D 40/02 401/172
7,309,184 B2 * 12/2007 Butcher ..... A45D 34/04 401/172
7,878,728 B2 * 2/2011 Nasu ..... B65D 83/0011 401/265
2004/0084343 A1 5/2004 An

* cited by examiner

DEVICE FOR DISPENSING AND APPLYING A COSMETIC OR CARE PRODUCT

The invention concerns the field of devices for dispensing and applying a cosmetic or care product.

Cosmetic products encompass all make-up products for the skin or superficial appendages as well as perfuming or odoriferous compositions for application to the body.

Care products comprise in particular those for application to the human or animal body to prevent or treat a pathology.

The invention relates in particular to a device for dispensing and applying such a cosmetic or care product taking a liquid, semi-fluid or pasty form.

Devices enabling the dispensing and application of a cosmetic product are known from the state of the art in various configurations. For example, document U.S. Pat. No. 64,732 discloses such a device, in particular a shaving brush of which the bristles are supplied with shaving cream or soap from an internal reservoir, the capacity of which is reduced by actuating a piston which is movable inside the reservoir.

In order to improve the dosing, that is to say the fine control of the amount of product dispensed, document US 2004/0084343 discloses a lipstick dispenser in which an endless screw actuates a piston movable in the hollow body of the device which forms a reservoir, in order to reduce the volume thereof progressively to induce, at a remote opposite location from the piston, the controlled expulsion of the lipstick. Nevertheless, the mechanism disclosed is bulky longitudinally, making the distributor itself bulky. Furthermore, it gives no indication as to the amount of product remaining in the dispenser.

Lastly, there is known from document WO2012102427 a cosmetic product applicator enabling a predefined amount of product to be dispensed. Its structure comprises a main container within which a fluid-tight piston moves on a threaded rod bored longitudinally. The threaded rod is coupled with a rotary mounting which makes it possible to drive the piston to displace inside the body of the container. This type of applicator, in which the threaded rod is in contact with the cosmetic product, is sensitive to fouling and this limits use thereof to certain cosmetic products (that are very fluid, not having the risk of hardening or drying etc.) and prevents being able to recharge it.

The object of the invention is to provide a device for dispensing and applying a cosmetic or care product, suited to products that are liquid to pasty, solving at least one of the aforementioned problems.

Thus, the invention relates to a device for dispensing and applying a liquid, semi-fluid or pasty cosmetic or care product. The device comprises an elongate hollow rotary body and an elongate hollow outer barrel which are butted to each other, and rotatable relative to each other. An application tip is fastened at an end of the rotary body, the rotary body and the outer barrel form an inner volume in which are provided a bored cylinder comprising a longitudinal duct, and an inner barrel comprising an open end by which is inserted the bored cylinder and an end which is closed so as to form a reservoir for the cosmetic or care product.

The bored cylinder is translationally fixed relative to the rotary body inside which it extends.

The device comprises a mechanism for transforming rotation of the rotary body relative to the outer barrel into a translational movement of the inner barrel relative to the bored cylinder inside the inner volume formed by said rotary body and outer barrel.

The relative movement between the inner barrel forming a reservoir and the bored cylinder entering said inner barrel by its open end leads to variation in the inner volume available in the barrel. A reduction in this inner volume when the inner barrel, by rising along said bored cylinder leading relatively to greater entry of the cylinder inside the barrel, drives expulsion of an amount of product corresponding to the reduction in volume via the longitudinal duct of the bored cylinder.

The transforming mechanism may comprise a threaded component joined to the inner barrel, and the assembly formed by the rotary body and the bored cylinder may comprise a threaded part configured to cooperate with the threaded component joined to the inner barrel such that the rotation of said rotary body drives the rotation of said threaded part and the translation of said threaded part and of the inner barrel along said threaded part, and as a corollary the translation of the inner barrel relative to the bored cylinder.

The device may furthermore comprise a piston fixedly mounted at one end of the bored cylinder inserted through the open end of the inner barrel, the piston comprising a peripheral surface the contact of which with the inner surface of the inner barrel provides sealing for the product, said piston comprising a central opening that is open to the longitudinal duct of the bored cylinder. In this case, the piston may comprise an elongate portion extending inside the longitudinal duct of the bored cylinder.

The device may further comprise a non-return valve located at an outlet of the longitudinal duct of the bored cylinder.

According to a first embodiment, the threaded part is formed by or on the bored cylinder, such that said bored cylinder has on its outer surface a screw thread so as to form a screw, the threaded component being a ring forming a nut on said bored cylinder.

The threaded part may be formed by addition of a hollow threaded rod to an outer surface of the bored cylinder.

The device may comprise a sleeve in the rotary body, said sleeve being free to rotate relative to said rotary body but unable to rotate relative to the outer barrel, said ring being inside the sleeve and said sleeve and said ring being configured such that said ring can translate within the sleeve but remain unable to rotate therein.

The sleeve may comprise, on an inner face, at least one longitudinal groove, and the ring may comprise at least one notch in which is inserted said longitudinal groove such that the ring is guided in longitudinal translation inside the sleeve on said longitudinal groove According to a second embodiment, the threaded part is formed by an inner surface of the rotary body having a screw thread, the threaded component being a ring having on at least part of its periphery a screw thread cooperating with the screw thread of the inner surface of the rotary body.

The ring may comprise two diametrically opposite threaded portions, projecting from the outer surface of the ring, and a longitudinal guide which extends inside the rotary body so as to guide said ring in longitudinal translation within said rotary body.

In any embodiment, the outer barrel may be transparent or translucent, or opaque.

Similarly, the inner barrel may be transparent or translucent, or opaque.

Still other particularities and advantages of the invention will appear in the following description.

In the accompanying drawings, given by way of non-limiting example:

Figure 1:
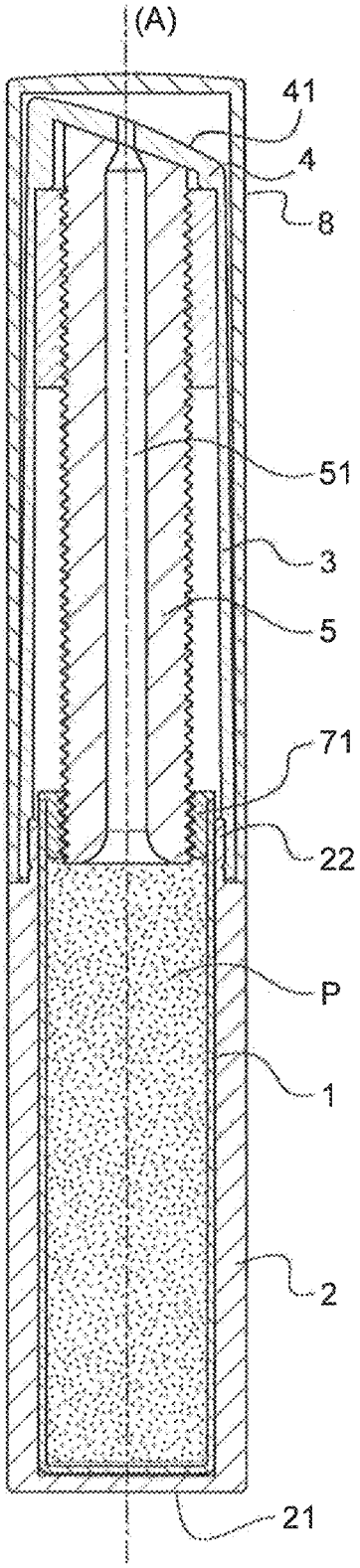
FIG. 1 shows a device in accordance with an embodiment of the invention, in a simplified cross-section.
Figure 2:
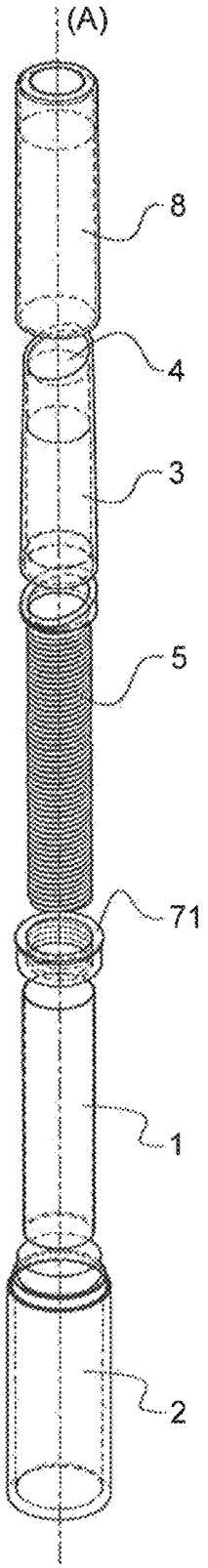
FIG. 2 shows an exploded view of the device of FIG. 1.

FIG. 1 shows a device in accordance with an embodiment of the invention. FIG. 2 moreover represents an exploded view of the device of FIG. 1, which details the constituent parts and enables the assembly to be apprehended. This device is described below for the dispensing and application of a cosmetic product, but may be used in identical manner for the dispensing and application of a care product.

The device enables the dispensing and application of a fluid, semi-fluid or pasty cosmetic product P. The cosmetic product P is contained in a reservoir referred to as inner barrel 1. In the example represented here, the inner barrel 1 has the shape of a right cylinder closed at one end and open at the other.

The device comprises an outer barrel 2. The outer barrel 2 forms the lower part of the dispensing and application device. It is of elongate shape, and may have a cylindrical or prismatic outer shape. The outer barrel 2 comprises a bottom 21 able to comprise a closing wall. Nevertheless, the outer barrel advantageously comprises an air inlet. This air inlet may be formed through the bottom wall 21. The air inlet enables air exchange between the inside and the outside of the outer barrel 2. In particular, it enables the inlet of air to the outer barrel on movement, described below, of the inner barrel 1 within the outer barrel 2 during the dispensing of the product. The outer barrel 2 also comprises an opposite open face 22, into which is inserted the inner barrel 1. The inner shape of the outer barrel 2 matches the outer shape of the inner barrel 1, clearance being allowed for. This enables longitudinal translation, or in other words sliding of the inner barrel 1 within the outer barrel 2, along a main axis (A) of the device.

The outer barrel 2 is advantageously transparent or translucent, which enables the position of the inner barrel 1 within the device to be seen. The position of the inner barrel 1 in the device furthermore corresponds to a given amount of remaining product. In other words, seeing the position of the inner barrel 1 enables the user to see the remaining amount of product, or conversely, the consumed amount of product.

If the inner barrel 1 is itself transparent or translucent, the product can be seen directly. This provides aesthetic value, and furthermore enables the user to identify the desired product by its appearance, in particular its color, its brilliancy, and/or its other visual characteristics.

The device also comprises a member which forms its upper part and which is referred to as rotary body 3. The rotary body 3 is of elongate shape, and may have a cylindrical or prismatic outer shape, and in particular an outer shape matching the outer shape of the inner barrel 2. The rotary body 3 is butted to the outer barrel 2. The rotary body 3 may be turned relative to the latter around the main axis (A) of the device. Examples of links which may be employed, between the rotary body 3 and the outer barrel 2, are described below with reference to FIGS. 3, 6 and 9.

The rotary body 3 is so designated because it constitutes the member which the user rotates, relative to the outer barrel 2, in order to induce the dispensing of cosmetic product by the device.

The rotary body 3 is hollow and thus defines, with the outer barrel 2 to which it is linked, an inner volume of the dispensing and application device.

An applicator tip 4 is fastened at an end of the rotary body 3. The applicator tip 4 has an application surface 41, by which the cosmetic product P is dispensed and which enables application, for example in a thin and even layer on the skin of the user of the device.

Within the inner volume formed by the rotary body 3 and the outer barrel 2, the device comprises not only the inner barrel 1 but also the bored cylinder 5. The bored cylinder 5 comprises a longitudinal duct 51 over the whole of its length, that is to say along the axis which it extends along which coincides with the main axis (A). The longitudinal duct 51 has a uniform or changing cross-section.

In the various embodiments of the invention, the bored cylinder 5 is translationally fixed relative to the rotary body 3, inside which it extends. According to the embodiment considered, the bored cylinder 5 may be rotationally fixed or rotatable, relative to the rotary body 3. In the embodiment of FIGS. 1 to 6, the bored cylinder 5 is rotationally fixed relative to the rotary body 3.

According to different variants of the various embodiments of the invention, the bored cylinder 5 may either be fixed to the rotary body 3 directly or via an intermediate component which may be the application tip 4, or be formed as one piece with the rotary body 3.

The bored cylinder 5 is inserted into the inner barrel 1 by its open end 22.

The device comprises a mechanism for transforming rotation of the rotary body 3 relative to the outer barrel 2 into translation movement of the inner barrel 1 relative to the bored cylinder 5.

Thus, within the inner volume formed by said rotary body and outer barrel, it is the inner barrel 1 which is movable, while the bored cylinder 5 remains fixed longitudinally. On account of the movement of the inner barrel 1, the bored cylinder enters to a greater or lesser extent within said inner barrel, which varies the inner volume available for the storage of the cosmetic product P.

A reduction in the available volume in the inner cylinder P drives expulsion of a corresponding amount of the product P via the longitudinal duct 51 of the bored cylinder 5.

The mechanism for transforming movement may have various configurations, two variants of which are respectively detailed with the aid of FIGS. 3 to 6, and with the aid of FIGS. 7 to 10. These examples of mechanisms, as well as that of FIG. 1, are based upon a threaded component (having a female or male screw thread according to the variants of the invention that are considered) linked to the inner barrel 1, and upon the fact that the assembly formed by the rotary body 3 and the bored cylinder 5 comprises a threaded part (male or female according to the variant considered) which is adapted to cooperate with the threaded component.

The rotation of said assembly formed by the rotary body and the bored cylinder drives the translation of said threaded component and of the inner barrel within said rotary body, and as a corollary the translation of the inner barrel relative to the bored cylinder.

In the example of FIG. 1, the threaded component is a ring 71 having an internal screw thread, referred to as female screw thread. The ring 71 is fastened to the open end 22 of the inner barrel 1, which it blocks off except at the location of its threaded opening.

On rising within the rotary body, the inner barrel 1 rises along the bored cylinder 5, the effect of which is to reduce the inner volume available within the inner barrel 1 for the product P, and to induce the expulsion of an amount of product P from the inner barrel 1 via the duct 51 of the bored cylinder 5.

The device may comprise a cap or lid 8, as is the case in the example represented in FIG. 1. The lid 8 enables the device to be closed in order to avoid the cosmetic product from being dispersed, to protect the dispensing tip, and to avoid inadvertent actuation of the device.

The lid 8 may also have an aesthetic role. It may bear a logo or text.

Figure 3:
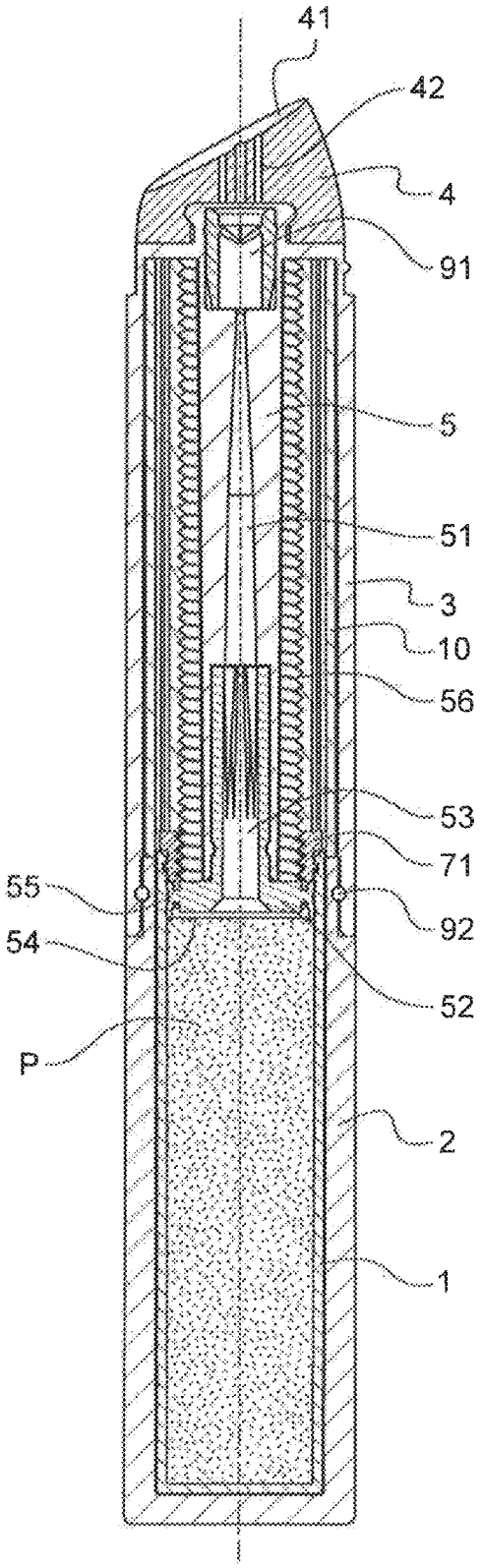
FIG. 3 shows a diagrammatic view in cross-section of a variant example of the embodiment of FIGS. 1 and 2.

FIG. 3 shows a cross-section view of a variant of the embodiment of FIGS. 1 and 2. An exploded view of the variant embodiment of FIG. 3 is presented in FIG. 4. The kinetics of operating this variant are identical to those described above with reference to said FIGS. 1 and 2. Nevertheless, the variant of FIG. 4 differs from that presented in FIGS. 1 and 2 basically by the features described below. A piston 52 is fastened to the end of the bored cylinder. The piston 52 comprises a central opening 53 which is open to the duct 51 of the bored cylinder 5. The central opening 53 thus provides fluidic communication between a frontal surface 54 of the piston 52, which is in contact with the product P in the bored cylinder 5, and said duct 51. The piston 52 is configured so as to have a peripheral surface 55 in sealing contact with the inner wall 11 of the inner barrel 1. Thus, when the inner barrel 1 rises around the bored cylinder 5, the reduction in available volume in the inner barrel 1 under the frontal surface 54 of the piston 52 drives the expulsion of an amount of product P corresponding to that reduction. The product is expelled via the central opening 53 of the piston 52, then the duct 51 of the bored cylinder, before reaching the application tip 4 which it passes through via dispensing orifices 42 before reaching the application surface 41.

The piston 52 enables full or almost full expulsion of the product, the residual volume in the inner barrel 1 being zero or practically zero when said inner barrel is raised to the maximum in the device, and the frontal face 54 of the piston 52 is in contact with or near the bottom of the inner barrel 1. Furthermore, the piston avoids the threaded part being in contact with the cosmetic product on use of the device. This avoids any fouling of said threaded part, and may, if applicable, enable the device to be filled again with cosmetic product without it being necessary to clean the threaded part.

The duct 51, in the example represented, has a changing cross-section. In particular, the duct 51 has a progressive restriction from its inlet (at its end inserted into the inner barrel 1) to its outlet. The change in cross-section, in particular its restriction, and/or a particular form of the duct 51 may for example enable the destructuring of the formula and the bursting of beads comprising a fluid that are present in the product P (for example a lip gloss, to improve the brilliancy obtained), just prior to the dispensing of said product P.

In the variant of the invention represented here, a non-return valve 91 is disposed between the outlet of the duct 51 and the application tip 4. The non-return valve 91 enables the product P contained in the device to be protected from the outside atmosphere. The non-return valve 91 also makes it possible, to a certain extent, to avoid the rotary body being actuated in the direction of rotation tending to suck back the product towards the inner barrel 1.

Advantageously, the non-return valve contributes to the general sealing of the dispensing device when the latter is in inverted position (application tip 4 oriented downward), for example in the handback of a user.

The non-return valve 91 may also assist the bursting of the beads present, where provided, in the product P.

Another difference between the device of FIGS. 1 and 2 and that of FIGS. 3 to 6 is the constitution of the threaded part of the bored cylinder. Whereas in the device of FIGS. 1 and 2, the bored cylinder 5 and the threaded part are of one-piece formation, in the variant of FIGS. 3 to 6 the threaded part is formed by a hollow threaded rod 56 which is joined onto the bored cylinder 5. In particular, the hollow threaded rod 56 forms a sleeve around the bored cylinder 5, that is to say around the outer surface of the bored cylinder.

Figure 5:
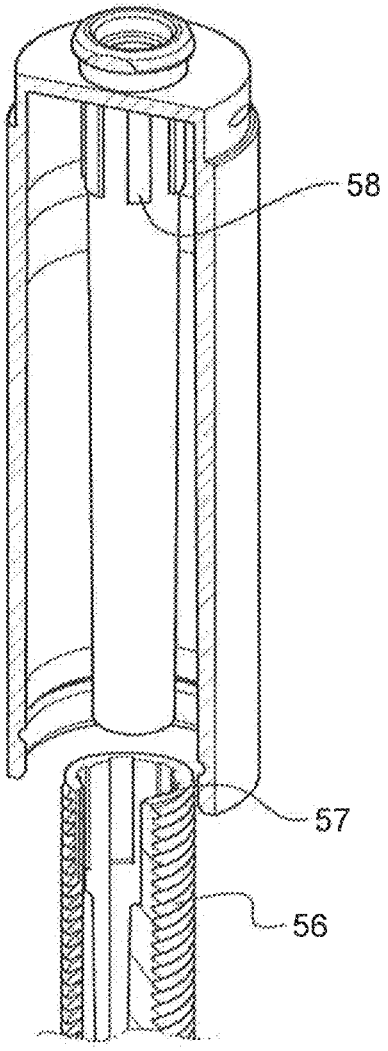
FIG. 5 shows a partial diagrammatic view of a first detail of the device of FIGS. 3 and 4.

As can clearly be seen in FIG. 5, in order to keep the hollow threaded rod 56 rotationally fixed relative to the bored cylinder 5, the hollow threaded rod 56 is provided, over a portion of its inside surface, with notches 57 of shape matching that of lugs 58 carried by the bored cylinder 5.

Figure 4:
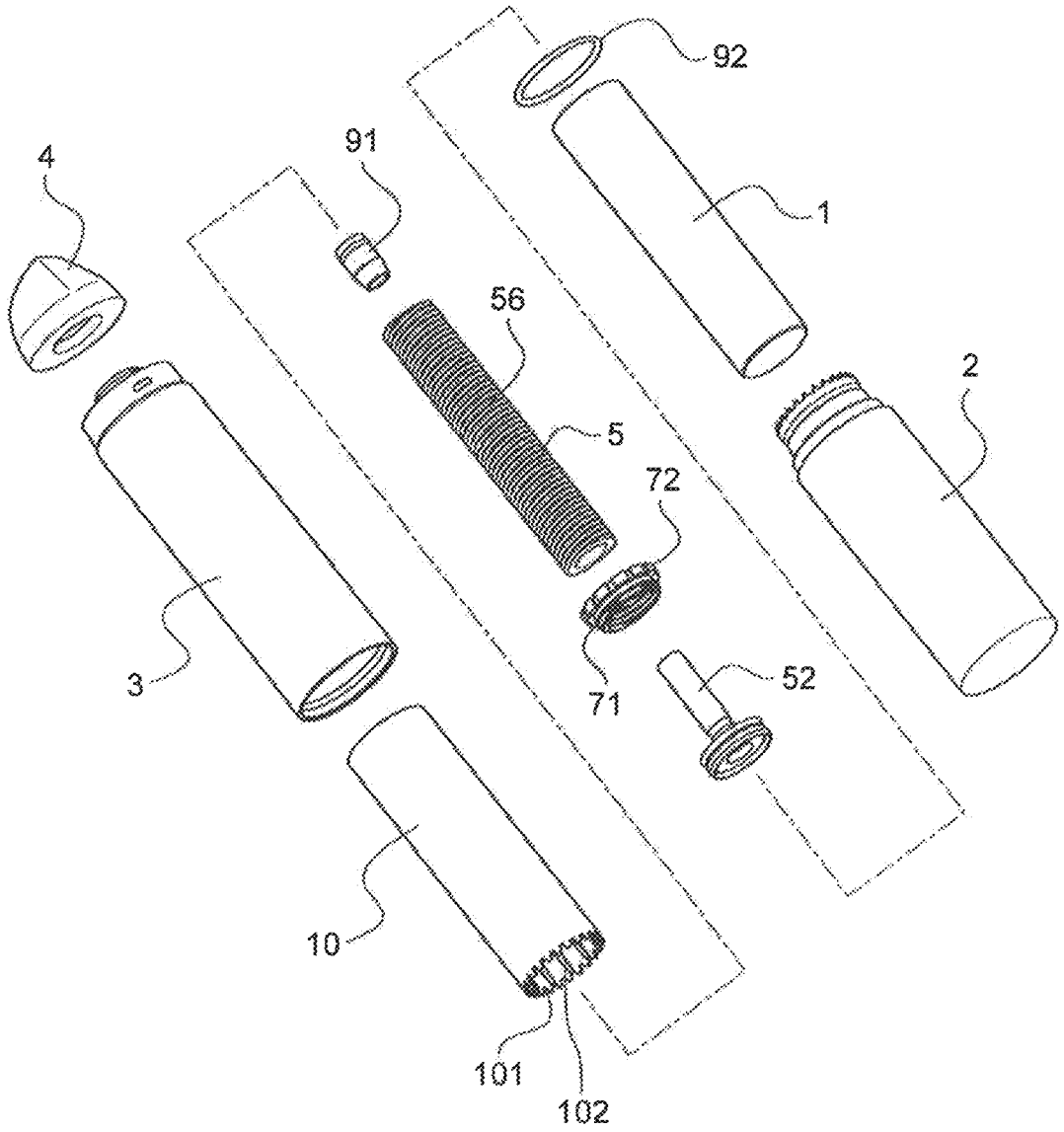
FIG. 4 shows an exploded view of the device of FIG. 3.
Figure 6:
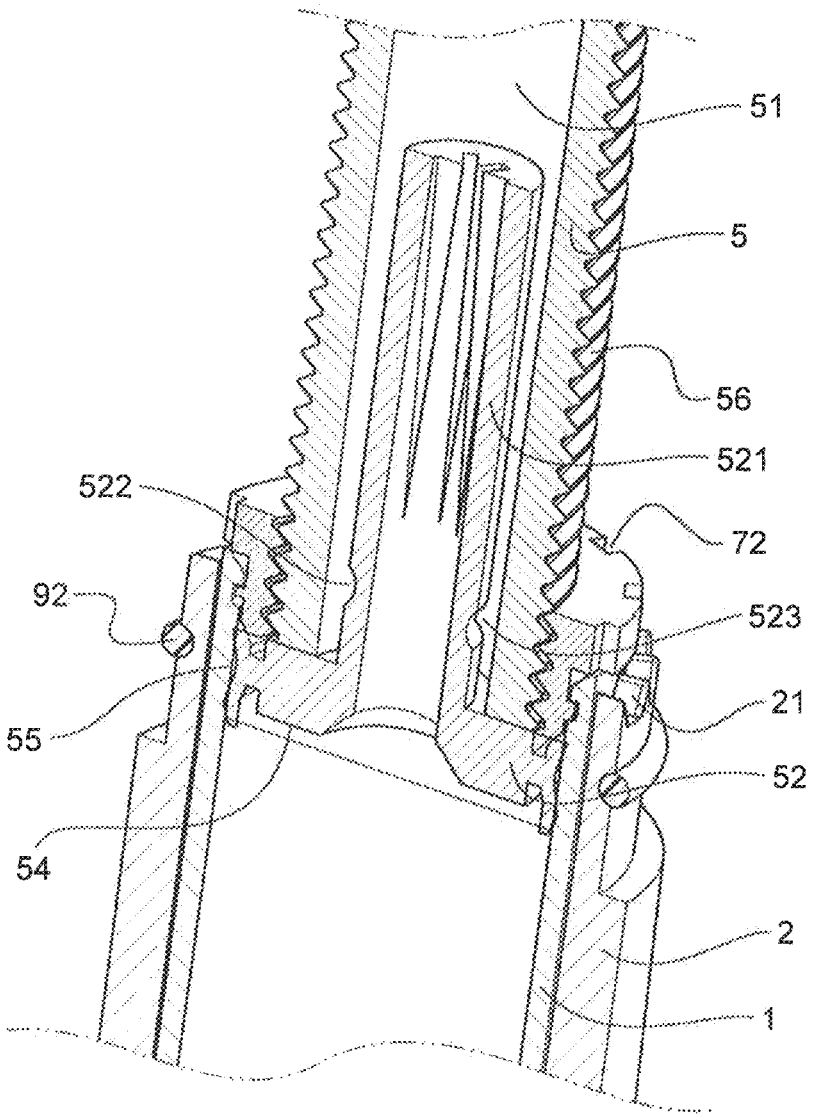
FIG. 6 shows a partial diagrammatic view of a second detail of the device of FIGS. 3 and 4.

FIG. 6 represents a detail view of the device of FIGS. 3 to 5, near the junction between the lower part of the device comprising the outer barrel 2 and the upper part comprising in particular the bored cylinder 5 and the rotary body 3 (not shown in FIG. 6).

The connection between the outer barrel 2 and the rotary body 3 is made, in the example represented here, by an "O" ring seal 92 inserted onto grooves respectively formed on an inner surface of the rotary body 3 and on an outer surface of the outer barrel 2.

As shown in FIG. 6, the piston 52 may comprise an oblong portion 521 inserted into the duct 5. The piston 52 is linked to the hollow cylinder 5 by virtue of a projection 522 from the inner surface of the duct 51 which is configured for snap-engagement in a circular groove 523 of the oblong portion 521.

In order to enable the translation of the ring 71 along the threaded part of the hollow 5, said ring 71 must be free for translation relative to the outer barrel 2 and the rotary body 3 while being held rotationally fixed relative to the outer barrel 2. To that end, the device comprises a sleeve 10, extending within the rotary body, which is fixed relative to the outer barrel 2 and which has guides for translation of the ring 71.

Thus, the outer barrel 2 comprises a notched formation 21 on its upper part, which is configured to engage with a corresponding toothed formation 101 of said sleeve, which locks the sleeve rotationally relative to the outer barrel 2. The sleeve comprises grooves 102 on its inner surface which are longitudinal, that is to say parallel to the main axis (A), along which the ring 71 is guided. The ring 71 may for this have, on its periphery, notches 72 which slide on longitudinal grooves 102.

The lid of the device has been omitted in FIGS. 3 and 4. Nevertheless, as suggests the outer shape of the application tip 4 as well as of the rotary body 3, in this variant of the invention the lid covers the application tip 4 and only a small end portion of the rotary body 3.

It is very clear that the distinctive features of the device of FIGS. 3 to 6, in particular the presence of a piston 52 at an end of the bored cylinder 5, the constitution of the threaded part of said bored cylinder 5, the means to ensure the translation of the threaded component (for example the ring 71), the shape of the lid 8, etc., may be applied (or not applied) independently of each other to any device having a configuration similar to the device of FIGS. 1 and 2.

Figure 7:
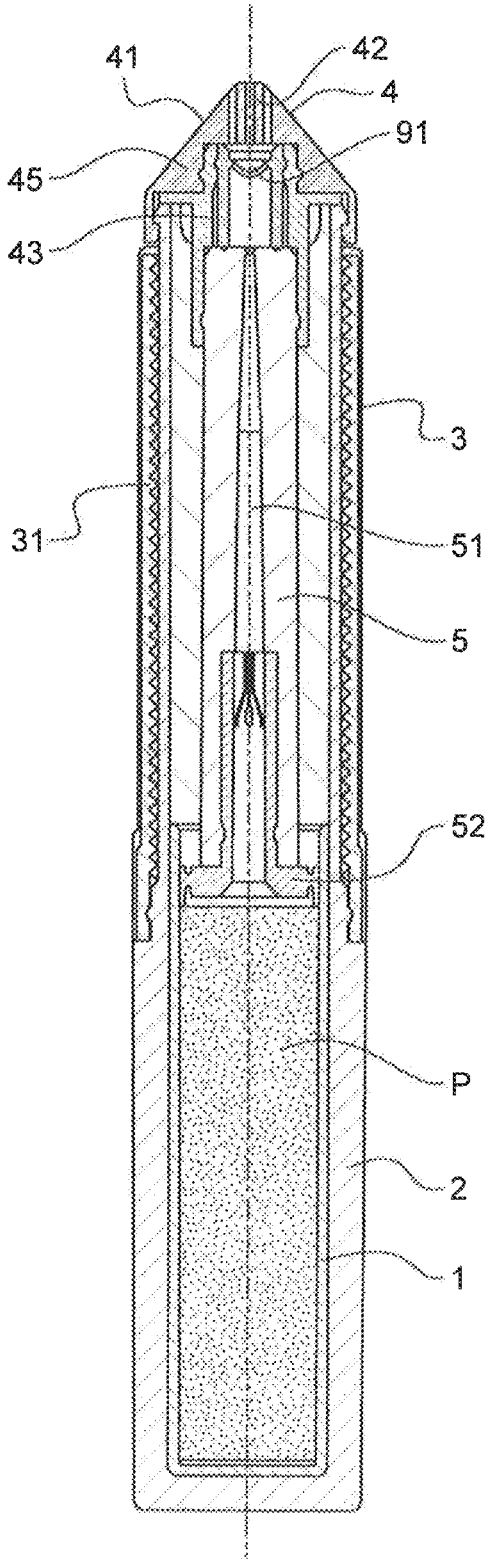
FIG. 7 shows a diagrammatic cross-section view of an example of another embodiment of the invention.
Figure 8:
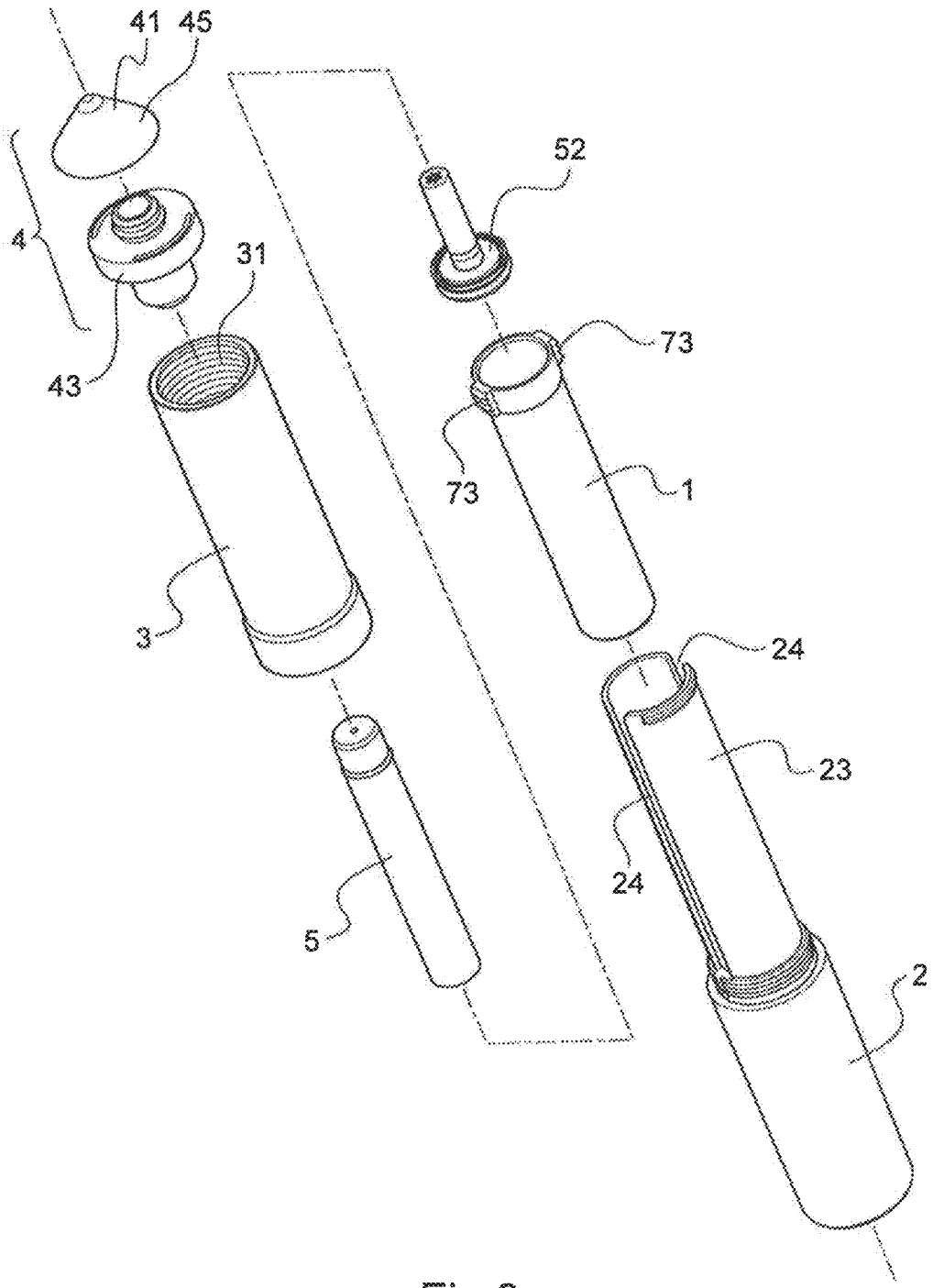
FIG. 8 shows an exploded view of the device of FIG. 7.

FIG. 7 shows a diagrammatic cross-section view of an example of another embodiment of the invention. FIG. 8 illustrates the device of FIG. 7 in an exploded view.

Figure 9:
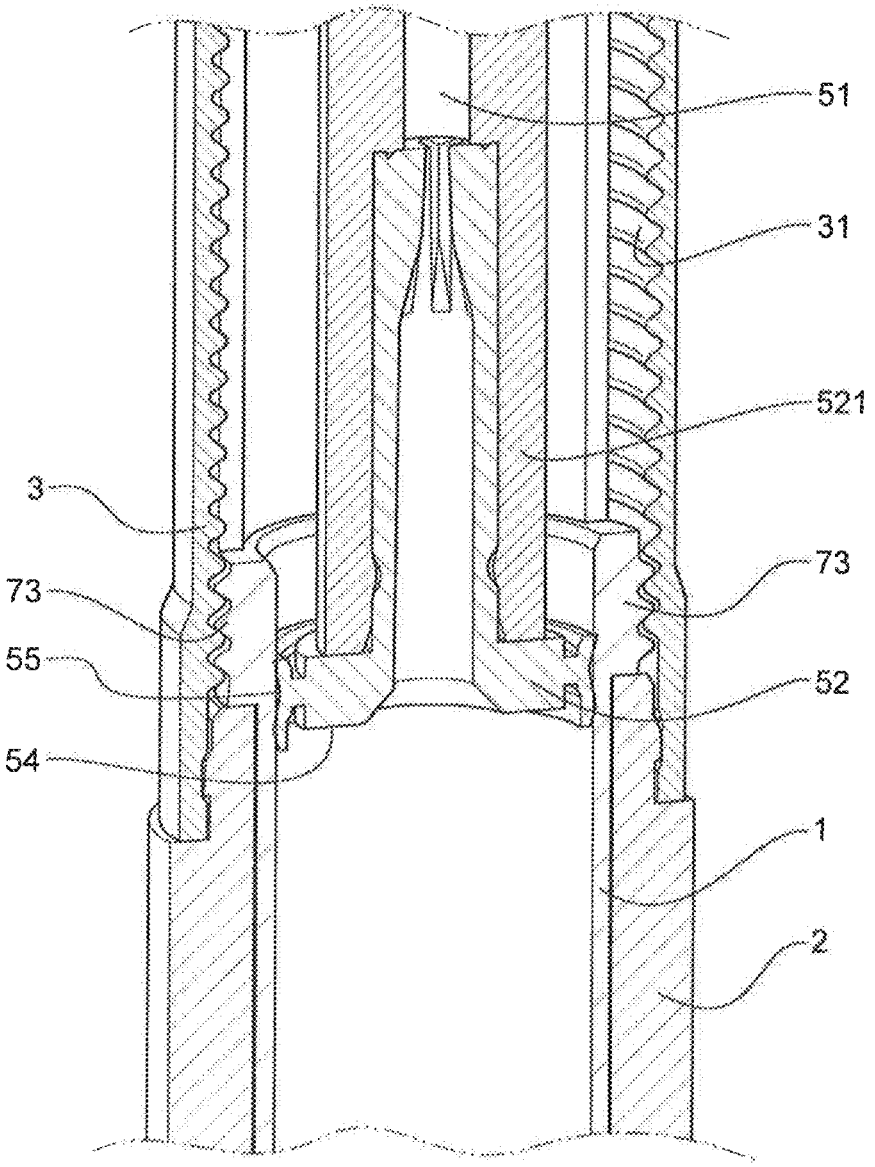
FIG. 9 shows a partial diagrammatic view of a first detail of the device of FIGS. 7 and 8.

In the embodiment of FIGS. 7 and 8, and as represented in a partial view of FIG. 9, the threaded part of the assembly formed by the rotary body 3 and the bored cylinder 5 is formed on an inner surface 31 of the rotary body 3, said inner surface 31 having a screw thread. The screw thread formed on the inner surface 31 is thus a female screw thread. The threaded component is a ring 71' rigidly linked to the inner barrel 1 or, as in the example represented here, integrally formed with said inner barrel 1.

The ring 71' comprises a screw thread over part of its periphery, cooperating with the screw thread of the inner surface 31 of the rotary body 3. This is thus a male screw thread, of matching diameter and same pitch.

In the example embodiment shown here, the ring 71' is joined to and integrally formed with the inner barrel 1, for example by molding. It comprises two threaded portions 73, provided in the upper part of the inner barrel 1, that is to say at its open end.

In order to guide the ring 71' (and thus the inner barrel 1) in translation in the device and prevent said ring 71' from tuning, a longitudinal guide 23 is formed at an end of the outer barrel 2. The longitudinal guide extends within the rotary body 3, in order to guide the rising of the inner barrel 1 in said rotary body 3.

In the example represented here, the longitudinal guide 23 comprises two longitudinal openings 24 in which the threaded portions 73 of the ring 71', which project from the rest of the ring, are able to slide.

Just as with the embodiment of FIGS. 3 to 6, the device of FIGS. 7 to 9 comprises a piston 52. The piston 52 makes it possible in particular, as explained with reference to FIGS. 3 to 6, to expel the entirety or almost so of the product P, and avoid fouling of the threaded part on use of the device.

Figure 10:
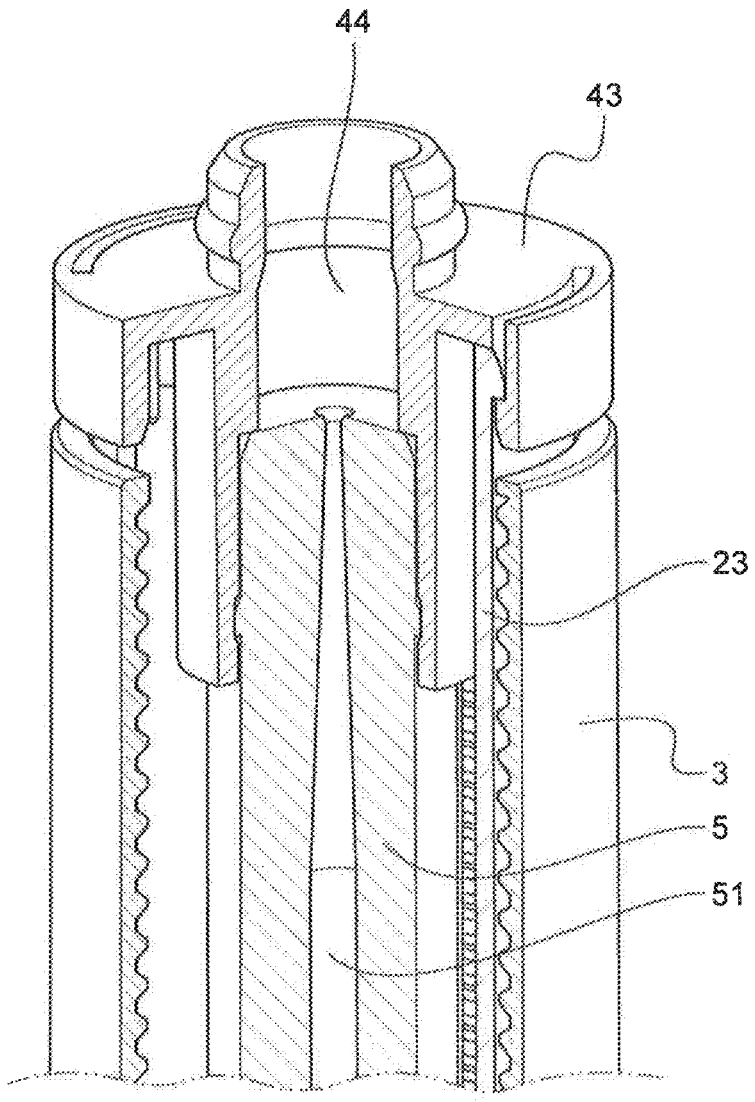
FIG. 10 shows a partial diagrammatic view of a second detail of the device of FIGS. 7 and 8.

FIGS. 7 and 8, and FIG. 10, illustrate an embodiment detail of the represented embodiment of the invention. A mounting 43 for the application tip 4 is disposed at the end of the device and enables its assembly. In particular, the mounting 43 is configured for its snap-engagement with the bored cylinder 5 and furthermore with the guide means 23 of the outer barrel. Thus the mounting 43, and thus more generally the tip 4, as well as the bored cylinder 5, remain fixed relative to the outer barrel 2 when the rotary body 3 is turned in order to induce the translation of the inner barrel within the device.

The mounting 43 also provides an end volume 44 configured to receive the non-return valve 91. Lastly, the mounting 43 is configured for the fastening, for example by snap engagement, of a hat 45 comprising the application surface 41.

It is notable that the application surface may have various forms, according to the type of product and the application zone concerned.

Thus, the application surface may be substantially conical, as in the example of FIGS. 7 to 9, or be substantially planar and inclined relative to the main axis (A) of the device, as in the example of FIGS. 3 to 6, or for instance be domed as in the example of FIGS. 1 and 2.

The devices presented are in particular configured for the application of a lip gloss, more commonly designated by the term "gloss".

The invention thus developed provides an applicator device for a cosmetic or care product enabling precise dosing of the amount of product to dispense (on account of the dosing by rotation of a rotary body), and according to the variant of the invention considered, avoiding the fouling of the dispensing mechanism and/or indicating the amount of product remaining and, conversely, consumed.

The invention claimed is:

1. A device for dispensing and applying a liquid, semi-fluid or pasty cosmetic or care product, said device comprising:

an elongate hollow rotary body and an elongate hollow outer barrel which are butted to each other and rotatable in relation to each other;

an application tip being fastened at an end of the rotary body;

the rotary body and outer barrel forming an inner volume in which are provided:

a bored cylinder comprising a longitudinal duct; and art inner barrel comprising:

an open end in which the bored cylinder is inserted; and a closed end forming a reservoir for the cosmetic or care product;

the bored cylinder being translationally fixed in relation to the rotary body, inside which the bored cylinder extends, and the device further comprising a rotation transforming mechanism configured to transform rotation of the rotary body in relation to the outer barrel into a translational movement of the inner barrel in relation to the bored cylinder inside the inner volume formed by said rotary body and outer barrel.

2. A device according to claim 1, wherein:

the rotation transforming mechanism comprises a threaded component joined to the inner barrel; and the assembly formed by the rotary body and the bored cylinder comprises a threaded part configured to cooperate with the threaded component joined to the inner barrel such that the rotation of said rotary body drives the rotation of said threaded part and the translation of said threaded component and of the inner barrel along said threaded part, and, as a corollary, the translation of the inner barrel in relation to the bored cylinder.

3. A device according to claim 2, wherein:

the threaded part is formed by or on the bored cylinder, such that said bored cylinder has on its outer surface a screw thread so as to form a screw, the threaded component being a ring forming a nut on said bored cylinder.

4. A device according to claim 3, wherein:

the threaded part is formed by addition of a hollow threaded rod to an outer surface of the bored cylinder.

5. A device according to claim 3, further comprising:

a sleeve in the rotary body, said sleeve being free to rotate in relation to said rotary body but unable to rotate in relation to the outer barrel;

said ring being inside the sleeve and said sleeve and said ring being configured such that said ring can translate within the sleeve but remain unable to rotate therein.

6. A device according to claim 5, wherein:

the sleeve comprises, on an inner face, at least one longitudinal groove and in which the ring comprises at least one notch in which is inserted said longitudinal groove such that the ring is guided in longitudinal translation inside the sleeve on said longitudinal groove.

7. A device according to claim 6, wherein:

the ring comprises two diametrically opposite threaded portions, projecting from the outer surface of the ring; and a longitudinal guide extends inside the rotary body so as to guide said ring in longitudinal translation within said rotary body.

8. A device according to claim 1, further comprising:

a piston fixedly mounted at one end of the bored cylinder inserted through the open end of the inner barrel;

the piston comprising a peripheral surface the contact of which with the inner surface of the inner barrel providing sealing for the product;

the piston comprising a central opening that is open to the longitudinal duct of the bored cylinder.

9. A device according to claim 8, wherein:

the piston comprises an elongate portion extending inside the longitudinal duct of the bored cylinder.

10. A device according to claim 1, further comprising:

to non-return valve located at an outlet of the longitudinal duct of the bored cylinder.

11. A device for according to claim 1, wherein:

the threaded part is formed by an inner surface of the rotary body having a screw thread, the threaded component being a ring having on at least part of its periphery a screw thread cooperating with the screw thread of the inner surface of the rotary body.

12. A device according to claim 1, wherein:

the outer barrel is transparent or translucent.

13. A device according to claim 12, wherein:

the inner barrel is transparent or translucent.

* * * * *